US006644393B2

(12) United States Patent
Roberts et al.

(10) Patent No.: US 6,644,393 B2
(45) Date of Patent: Nov. 11, 2003

(54) CYLINDRICAL HEAT EXCHANGER

(75) Inventors: Josh Roberts, Dover, NH (US); Scott Rowe, Dover, NH (US)

(73) Assignee: Laars, Inc., Newport Beach, CA (US)

( * ) Notice: Subject to any disclaimer, the term of this patent is extended or adjusted under 35 U.S.C. 154(b) by 0 days.

(21) Appl. No.: 10/123,564

(22) Filed: Apr. 16, 2002

(65) Prior Publication Data

US 2003/0192684 A1 Oct. 16, 2003

(51) Int. Cl.[7] ..... F28F 9/02

(52) U.S. Cl. ..... 165/174; 165/163; 165/176; 29/890.052

(58) Field of Search ..... 165/125, 163, 165/176; 29/890.052

(56) References Cited

U.S. PATENT DOCUMENTS

| | | | | | |
|---|---|---|---|---|---|
| 667,809 | A | * | 2/1901 | Taege | 165/95 |
| 1,288,055 | A | * | 12/1918 | Langsenkamp | 165/162 |
| 1,853,322 | A | * | 4/1932 | Rose | 165/154 |
| 2,044,457 | A | * | 6/1936 | Young | 165/144 |
| 2,159,913 | A | * | 5/1939 | Tenney | 165/75 |
| 2,260,594 | A | * | 10/1941 | Young | 165/125 |
| 3,746,084 | A | * | 7/1973 | Ostbo | 165/163 |
| 4,206,807 | A | | 6/1980 | Koizumi et al. | |
| 4,297,987 | A | | 11/1981 | Bushee | |
| 4,303,042 | A | | 12/1981 | Sumiyoshi | |
| 4,386,652 | A | * | 6/1983 | Dragojevic | 165/144 |
| 5,038,854 | A | | 8/1991 | Peterson, III | |
| 6,233,824 | B1 | | 5/2001 | Dobbs et al. | |
| 6,305,331 | B1 | | 10/2001 | Fullemann et al. | |
| 6,311,646 | B1 | | 11/2001 | Selmani | |

* cited by examiner

*Primary Examiner*—Allen Flanigan
(74) *Attorney, Agent, or Firm*—Buchanan Ingersoll, P.C.

(57) ABSTRACT

A cylindrical heat exchanger member can be formed from multiple stacked ring shaped tubular members wherein an inlet and outlet of each ring shaped member terminate at a single header interface, thus permitting access to the inlet and outlet of each ring shaped member at a single location which enables rapid configuration of an combination of flow paths through the multiple ring shape members as well as simple and efficient cleaning of each ring shaped member.

10 Claims, 9 Drawing Sheets

CYLINDRICAL HEAT EXCHANGER

BACKGROUND

This invention relates generally to heat exchangers, and more particularly to a cylindrical heat exchanger member designed to be used: in, for example, a commercial boiler/water heater. Boilers/water heaters in general are well known in the art, as are cylindrical heat exchanger members. In the context of heat exchangers, the term "cylindrical" denotes the general overall shape of the heat exchanger member.

Early heat exchanger members have been configured from straight tubular members arranged in adjacent rows, forming a generally "flat" rectangular member. Water, typically, is circulated through the tubular members where it is heated, such as by a burner located inclose proximity to the tubular members. The heated water is then circulated downstream for use elsewhere in the heating system. As requirements for heating capacity increased, cylindrical shaped heat exchanger members were created to increase the firing density of the boiler. Firing density is generally defined as the output in British Thermal Units ("BTUs") divided by the combustion chamber volume. Operating the burner at a higher temperature can provide an increase in firing density since the BTU output can be increased without reducing combustion chamber volume. However, an off-setting consideration is the effect of combustion chamber volume on emissions. In particular, emissions, or waste products, such as CO and NOx, generally increase as-a result of operating the burner at a higher temperature for a given volume combustion chamber. There is also another important factor which must be considered in regard to the relationship between BTU output and combustion chamber volume. This factor is the effective surface area of the heat exchanger member. Generally, the larger the surface area of the heat exchanger member, the higher the BTU output that can be achieved for a given combustion chamber volume and burner temperature. Consequently, it can be understood that the firing density of a boiler can be increased while maintaining a proper combustion chamber volume by designing a heat exchanger member with the largest possible surface area and the smallest overall size.

In the prior art, firing density has been increased using a heat exchanger member configured by arranging straight tubular members in a circular pattern to form a cylindrical shaped member. In this manner, the overall volume of the heat exchanger member is reduced while maintaining surface area, thus increasing the firing density for a given combustion chamber volume. To circulate and control the flow of the water through the multiple straight tubes, a header is connected at both the top and the bottom ends of the straight tubes to control flow through each tube. One of the two headers commonly has both the inlet and outlet connections for circulating the water through the straight tubular members. The headers can be conifigured internally to provide desired flow paths through the tubular members.

In addition to straight tube cylindrical heat exchanger members, it is also known in the prior art to use one or more single hollow tubular members which are wound in a spiral configuration to create a compact, generally cylindrical shaped heat exchanger member. However, like straight tubular members, each end of the spiral shaped tubular members must communicate with a header for circulating water therethrough. The water circulated through the. tubular members is heated by a burner, which, for reasons of compactness, is typically disposed concentrically within the cylindrical shaped heat exchanger member. After being heated, the water is circulated from the boiler for utilization elsewhere in the heating system.

One disadvantage of conventional cylindrical heat exchangers members using straight tubes, such as described above, is a less efficient ratio of surface area to combustion chamber volume. Another disadvantage is that the flow path of the water through the tubular members cannot be readily reconfigured from the original configuration, in large part due to the use of two separate headers. In fact, new headers would likely have to be made to change the flow path. Moreover, if the boiler size drops, the length of the straight tubes is shortened. However, the bulk water flow cannot be reduced because the number of tubes is the same, and therefore smaller, less expensive pumps cannot be used even though the boiler size is smaller. Also, cleaning the insides of the tubular members is difficult because each end of the multiple tubular members in prior art type heat exchanger members is connected to a separate header at opposite ends of the tubes. Furthermore, the conventional cylindrical heat exchanger members with top and bottom headers generally are not very effective at keeping debris and scale from collecting in the bottom header.

Accordingly, there is a need for a cylindrical shaped heat exchanger member which can provide a large surface area in a compact package in order to increase the firing density of the boiler, while maintaining a proper combustion chamber volume so that emissions are reduced. Furthermore, there is a need for such a cylindrical heat exchanger which also provides for easily cleaning the hollow tubular members and enables convenient reconfiguration of the flow path of the water through the hollow tubular members.

SUMMARY

A cylindrical heat exchanger member of a heating boiler/water heater is provided wherein the cylindrical heat exchanger member is formed of multiple stacked tubular rings. Water, the typical heating medium, is circulated through the stacked tubular rings and heated by a burner disposed generaly concentrically within the stacked tubular rings. Each end of each of the multiple stacked tubular rings can be terminated at a single longitudinally extending header which intersects each tubular ring. The header can have inlet and out let connections for circulating water from a Water source through the tubular rings and out therefrom for use elsewhere in the heating system. A water barrier can be positioned within the header, and can be interchangeable, to provide easily reconfigured control of the flow path of the water through the cylindrical heat exchanger member. The number of stacked tubular rings can easily be varied, and more than one row can be provided, such that nested stacks of tubular rings can be used to form a dual row cylindrical heat exchanger member. Also, the number of rings can be reduced if the size of the boiler reduced, permitting a lower bulk water flow and thus use of a smaller less expensive pump. The single header also enables efficient cleaning of the inside of each tubular ring due to easy access to each end of each tubular ring at a single location. Moreover, the tubular ring design is more effective getting debris and scale swept out of the headers because the water flow keeps the debris and scale agitated so it is more easily swept out.

The boiler in which the cylindrical heat exchanger member is utilized can be similar to conventional boilers, in that the cylindrical heat exchanger member can be enclosed in a housing portion connected to an air/gas delivery system. The air/gas delivery system can include a blower and a burmer, which is typically disposed generally concentrically within the stacked tubular rings. The air/gas delivery system can be connected to a gas train which supplies fuel to the burner, and a flue transition member can be provided next to or as part of the housing portion for exhausting combustion products created by the burner. Water is circulated through the tubular rings where it is heated by the burner, and thereafter is circulated downstream of the boiler for utilization elsewhere in the heating system.

Other details, objects and advantages of the invention will become apparent from the following detailed description and the accompanying drawings FIGS. of certain embodiments thereof.

BRIEF DESCRIPTION OF THE DRAWING FIGURES

A more complete understanding of the invention can be obtained by considering the following detailed description in conjunction with the accompanying drawings, in which.

DETAILED DESCRIPTION OF CERTAIN EMBODIMENTS

Figure 1:
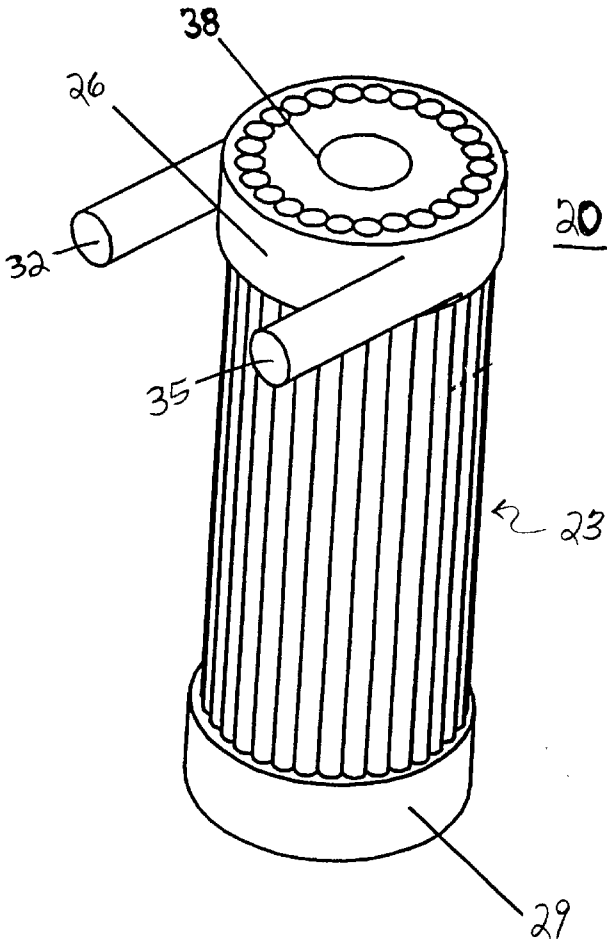
FIG. 1 (PRIOR ART)
FIG. 1 is a perspective view of a: prior art type cylindrical heat exchanger member.
Figure 2:
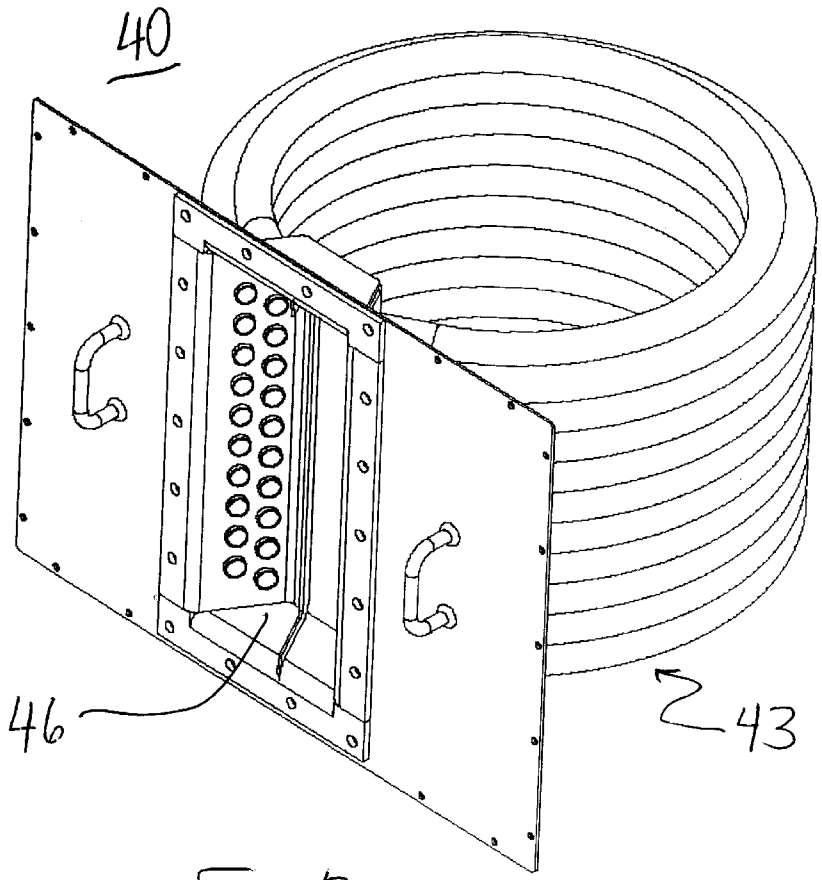
FIG. 2 is a perspective view of a presently preferred embodiment of a cylindrical heat exchanger member.

To aid in understanding the invention, it maybe helpful to first describe a prior art type cylindrical heat exchanger member 20, such as shown in FIG. 1, having multiple straight tubular members 23 which are connected at each end to separate top 26 and bottom 29 headers. The tubular members can be arranged in a side-by-side, generally circular arrangement thus forming a cylinder, and hence the "cylindrical" designation. One of the two headers 26, 29, in this case the top header 26, has inlet 32 and outlet 35 connections adapted for connection to an external water source which will provide the water which is to be circulated through the individual tubular members 23. An opening 38 in the top header 26 is provided through which a burner element (not shown) can be inserted generally concentrically into the interior of the cylinder formed by the tubular members 23. In practice, the cylindrical heat exchanger member 20 will generally be housed in a combustion chamber/housing portion of a boiler/water heater, and the burner is fueled by an air/gas mixture to heat the multiple tubular members 23, and thus the water circulated within them. The heated A ater will thereafter be circulated from the heat exchanger member 20 for use downstream of the boiler elsewhere in the heating system. A disadvantage associated with the conventional heat exchanger member, 20 is that the surface area relative to the combustion chamber volume can be less than desirable. Additionally, the use of more than one header 26, 29 and the related inability to access each end of the tubular members 23 at a single location, creates difficulties with regard to cleaning and maintenance of the heats exchanger member 20. For example, it can be difficult to access either the inside of the headers 26, 29 or the surface of the individual tubular members 23 facing the inside of cylinder, which can be necessary for proper cleaning and maintenance. In. particular, a large amount of boiler disassembly can be required, including the removal of both of the headers 26, 29 from each of the multiple tubular members 23. Such disassembly can also be needed in order to clean the outer surface of the tubular members 23 which face the inside of the cylinder. The radius of the cylindrical heat exchanger member 20 is generally made as small as possible, with due regard to surface area and combustion chamber volume, thus limiting access to the inside of the cylinder. Other significant disadvantages which can be associated with the conventional cylindrical heat exchanger member 20 are related to controlling the flow path of water through the various tubular members 23 and the external water connections. For example, the headers 26, 29 are initially configured to provide a particular flow path, which determines the amount of passes, i.e., the number of times the water is circulated through the tubular members 23 before being passed out of the heat exchanger member 20. This is normally specified by the customer at the time of purchase and cannot be altered thereafter. Thus, any change would require a new top 26 and/or bottom 29 header. Similarly, the headers 26, 29 of the conventional cylindrical heat exchanger member 20 also typically cannot be reconfigured for different external water connections. Thus, it can also be necessary for customers to specify the positioning of the external water connection, i.e., whether they will be on the right or left side when ordering the boiler. As a result, if the boiler is to be used with a different system, or the water connections are to be altered, the headers 26, 29 cannot simply be reconfigured to accommodate the changes.

Generally, in regard to firing density, the use of multiple straight tubes 23 to form the cylindrical heat exchanger member 20 can result in a less compact design for the amount of surface area provided, resulting in a lower firing density than otherwise possible. This can be understood one respect as owing to the space savings which can be achieved, according to an aspect of the present invention, by rolling the long straight tubes used in some prior art type heat exchanger-,designs into ring shaped tubular members and -stacking them to form a more compact cylindrical shaped heat exchanger. The compromise between height and diameter accomplished using shaped tubular members can provide a larger surface area for a given volume, thus resulting in a higher firing density while retaining a proper combustion chamber volume for reduced CO and NOx emissions.

Referring now to FIGS. 2 through 5, a presently preferred embodiment of a cylindrical heat ex changer member 40 is shown, which can be created by stacking multiple tubular rings 43 and connecting each end 44, 45 (FIG. 3) of the multiple annular tubes 43 to a single header 46. (Consequently, each tubular ring thus does not form a complete, continuous circle. Rather, the header 46 extends longitudinally along the cylinder intersecting each one of the stacked tubular rings 43, from the top of the stack to the bottom. The term "stacked," as used herein, is intended to encompass any arrangement of ring shaped tubular members which forms a generally cylindrical shape. The header 46, can thus provide easy access to each end 44, 45 of the tubular rings 43 at a single location on one side of the heat exchanger member 40. This allows for simple control, over the flow paths through the tubular members 43 as well as convenient cleaning of the inside of each of the tubular members 43. Unlike some prior art designs, the cylindrical heat exchanger member 43 also does not promote the deposition of debris in the header 46. For example, the headers 26, 29 of the prior art cylindrical heat exchanger member 20 (FIG. 2) can become clogged with debris. Debris, which can enter through the header, and pieces of scale which form as the water is heated, tend to collect in the bottom header 29 instead of being swept out. The prior art cylindrical heat exchanger member 20 is designed to try and "suck" the debris and scale vertically through the straight tubes and out the top header 26. However, the design tends to not be very effective at doing so.

In a presently preferred embodiment, the ring shaped tubular members can be stacked concentrically, i.e., the center of each tubular ring is coaxial with the center of the other tubular rings. Additionally, especially where more than one row of nested rings are used, the tubular rings can have different diameters, and can be staggered (shown best in FIG. 7). However, it should be understood that other configurations may also become apparent to those of skill in the art in light of this disclosure.

Figure 3:
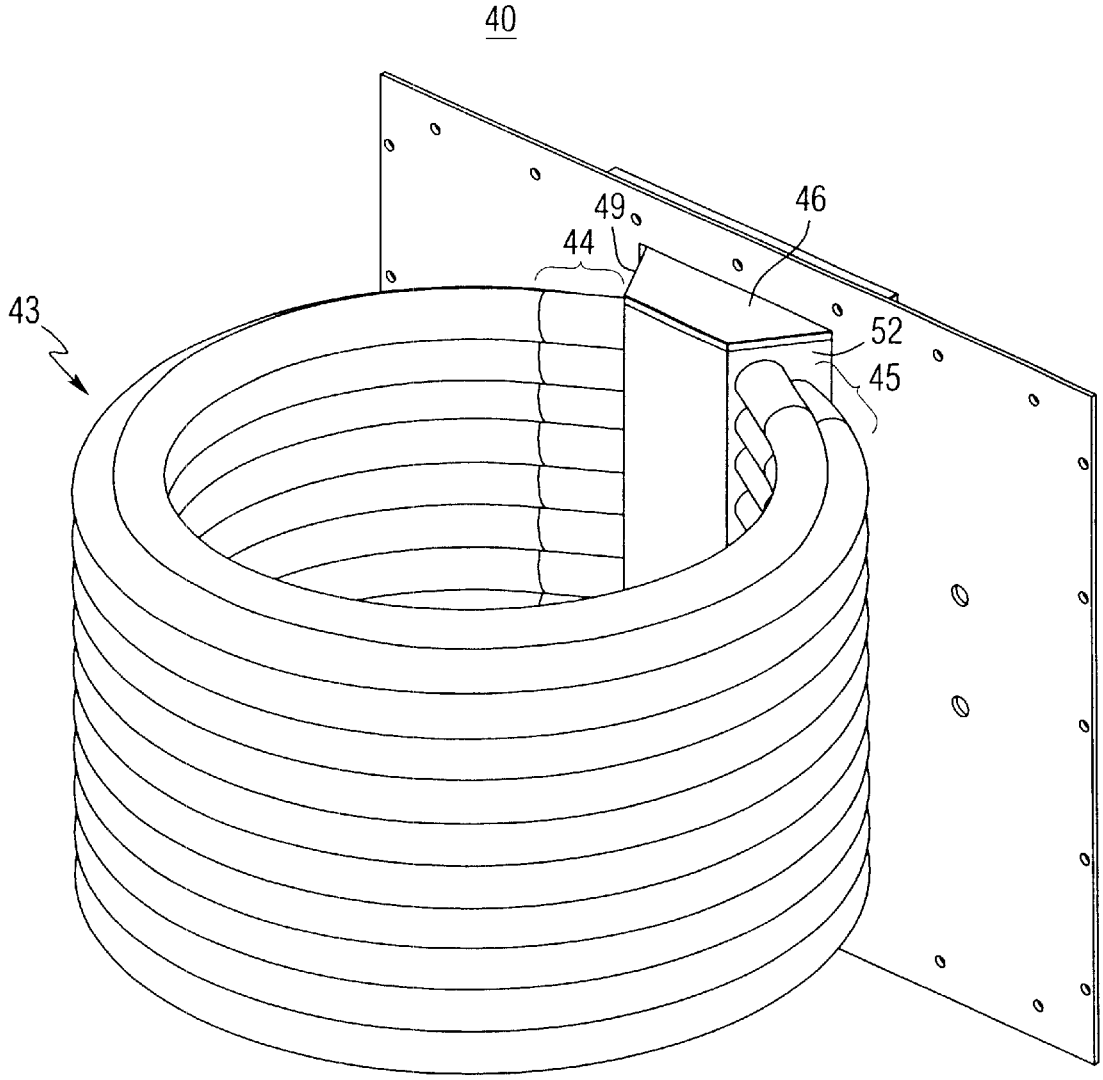
FIG. 3 is a perspective view of the opposite side of the heat exchanger member shown in FIG.
Figure 4:
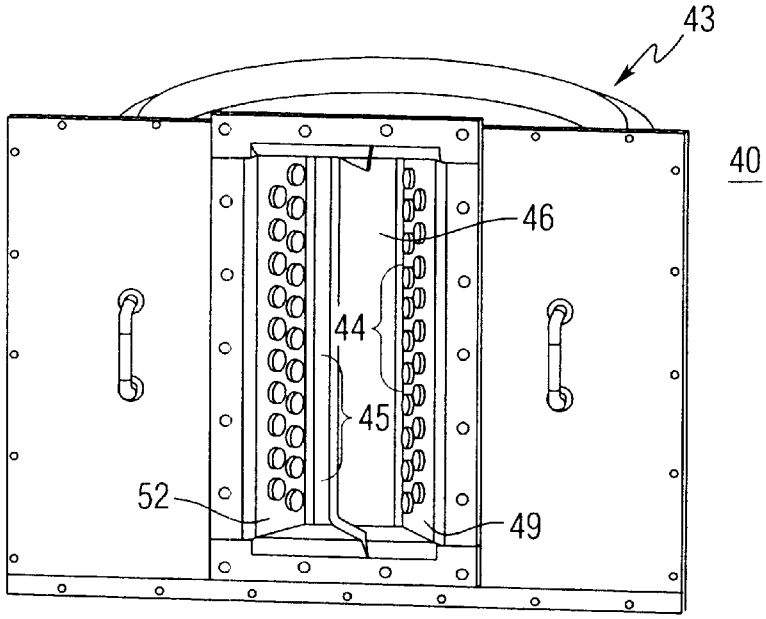
FIG. 4 shows a presently preferred embodiment of a header for the heat exchanger member shown in FIG. 1.
Figure 5:
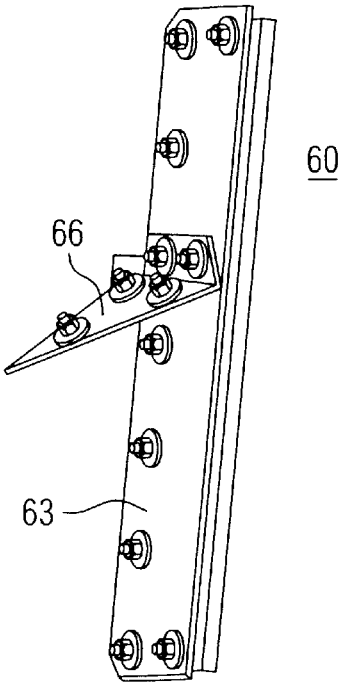
FIG. 5 illustrates a presently preferred embodiment of a water barrier.
Figure 6:
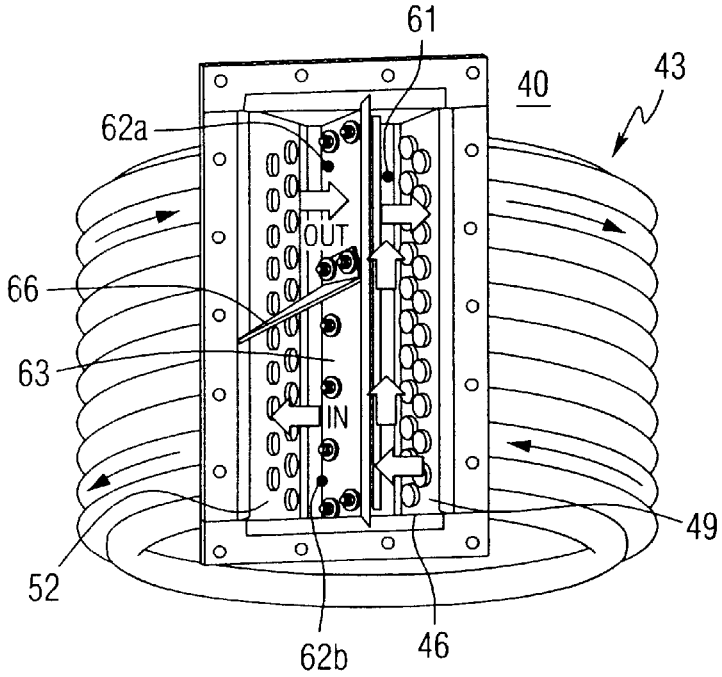
FIG. 6 is a perspective view illustrating the water barrier positioned in the header shown in FIG. 4.

In FIG. 3, it can be seen that each end 44, 45 of each of the multiple annular tubes 43 terminates at one of left 49 and right 52 faces of the single header 46. The two faces 49, 52 of the header 46 are spaced apart, and formed at an oblique angle to each other, to provide ample room within the header 46 for easy access each end 44, 45 of the multiple ring shaped tubular members 43, as seen best in FIG. 4. In this manner both ends of each annular tube 43 are oriented relative to the header 46 opening such that direct line-of-sight access is provided to the tube ends for cleaning or other purposes. This arrangement greatly simplifies control over the flow passes of the water through the ring shaped tubular members 43, by using a water barrier 60, as illustrated in FIGS. 5 and 6. The presently preferred embodiment of the water barrier 60 shown can be utilized for separating the flow through the tubular members 43 in various flow paths. For example, the water barrier 60 configuration shown separates the flow through the heat exchanger member 40, by separating the header 46 into three regions a right side 61, left side 62, and upper 62*a* and lower 62*b* regions on the left side. The flow path created by this configuration is shown by the directional arrows in FIG. 6. The water barrier 60 accomplishes this flow separation using a central divider 63 which, when the water barrier 60 is positioned in the header 46, separates one end of each of the tubular members 43 from the other end, essentially splitting the header 46 into two sides 61, 62. In one of the two sides 61, 62 created by the central divider 63, the left side 62 in the embodiment shown, a partition 66 is provided which separates, on the left side 62, the ends of upper tubular members from the ends of lower tubular members. The partition 66 thus divides the left side into two smaller, upper 62*a* and lower 62*b* regions. As shown by the directional arrows, water flows into the header 46 in the lower left region 62*b* and around through the lower tubular members into the right side 61 of the central divider 63. From there, the water flows up the right side 61 of the water barrier 60 into upper tubular members, through which the water then flows into the upper region 62*b* of the left side 62 defined by the partition 66. From the upper left region 62*a*, the water is circulated out of the header 46 to destinations downstream of the boiler for use elsewhere in the heating or domestic hot water system. Consequently, as can be understood, the water flow paths through the tubular members 43 can be controlled simply by configuring the water barrier 63 to direct the flow of water through the desired tubular members 43. The header 46 can be designed for easy interchangeability with other differently configured water barriers to provide a variety of different flow paths.

Figure 7:
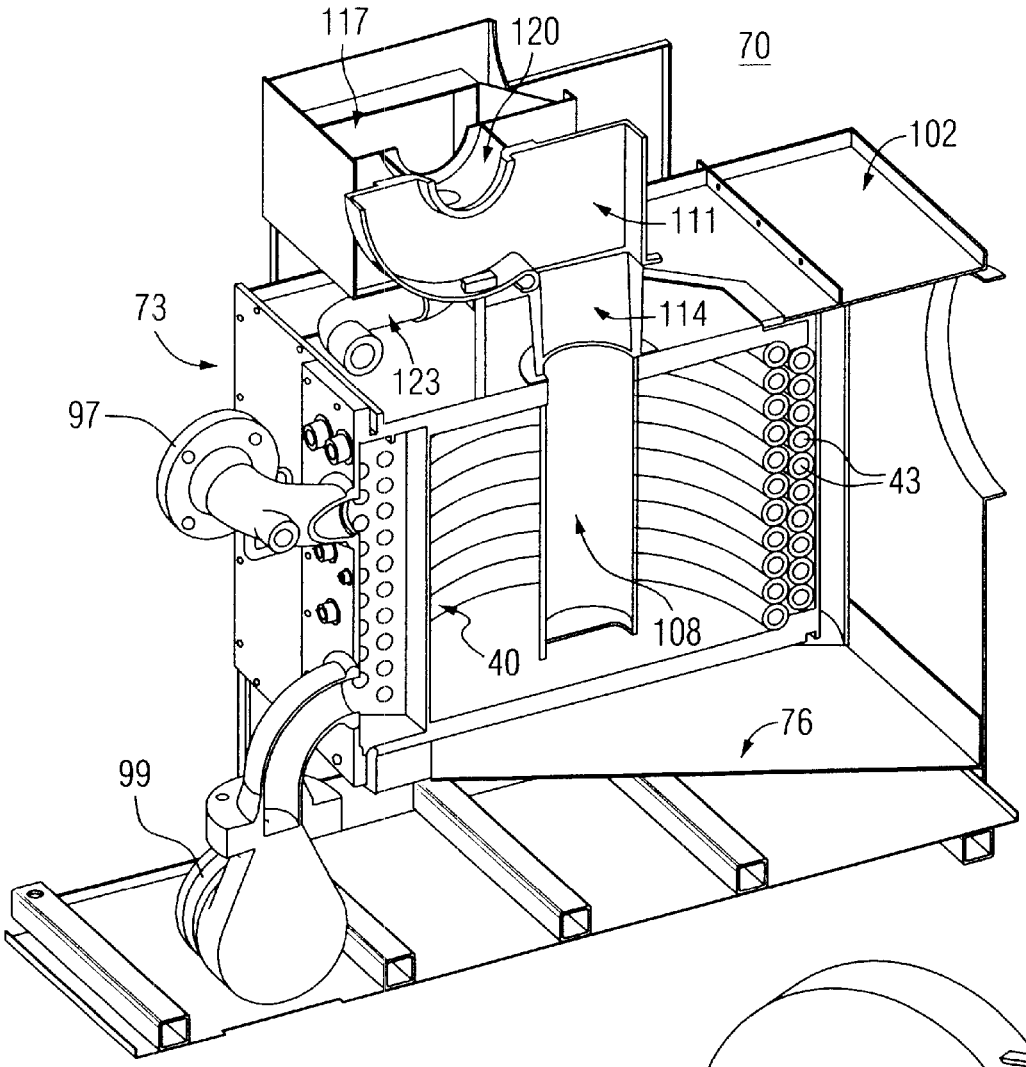
FIG. 7 is a perspective, partial section view of a presently preferred embodiment of a commercial boiler using a cylindrical heat exchanger member as shown in FIG. 2.
Figure 8:
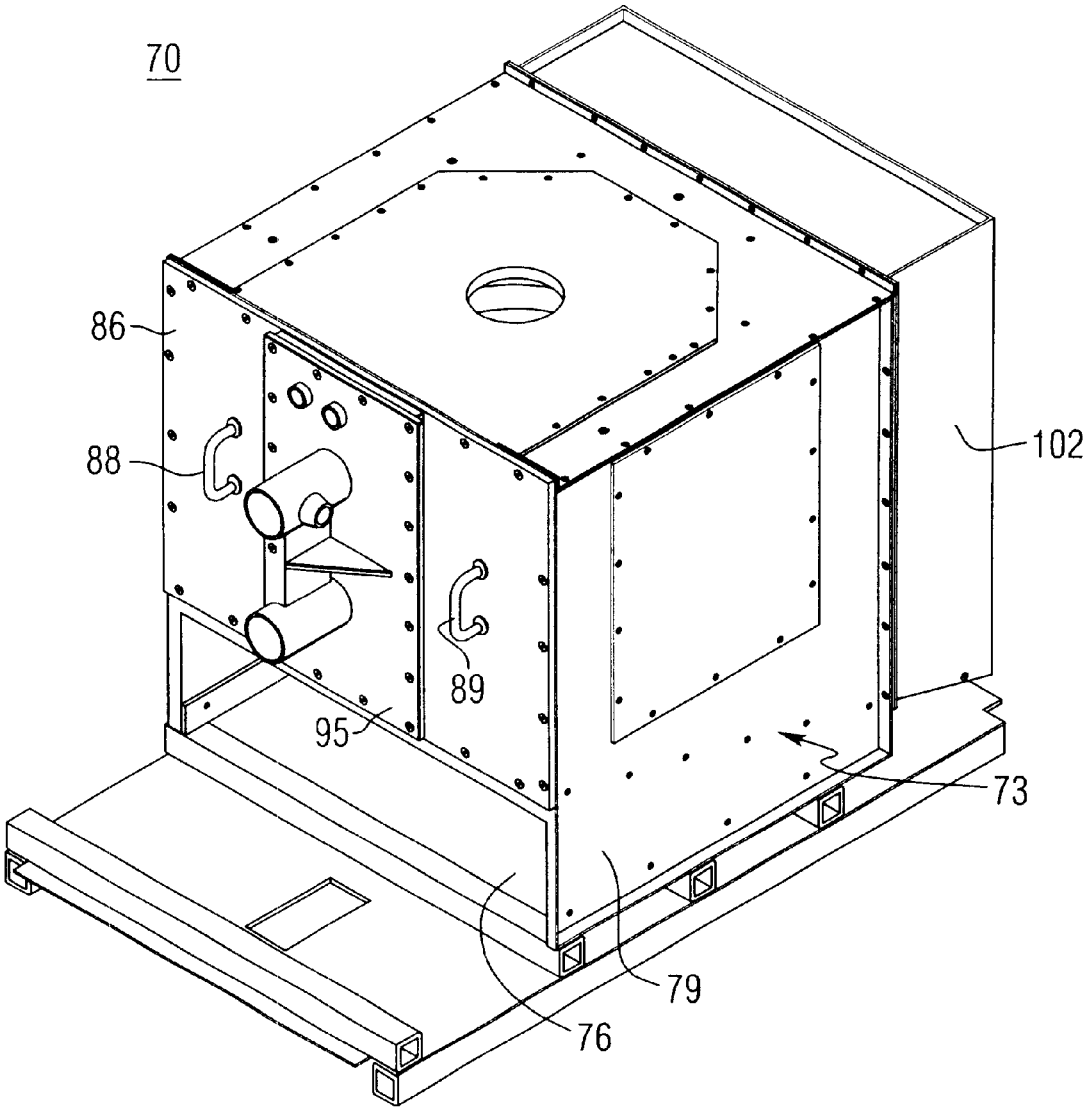
FIG. 8 is a perspective view of a combustion charnber housing portion of the boiler shown in FIG. 7.
Figure 9:
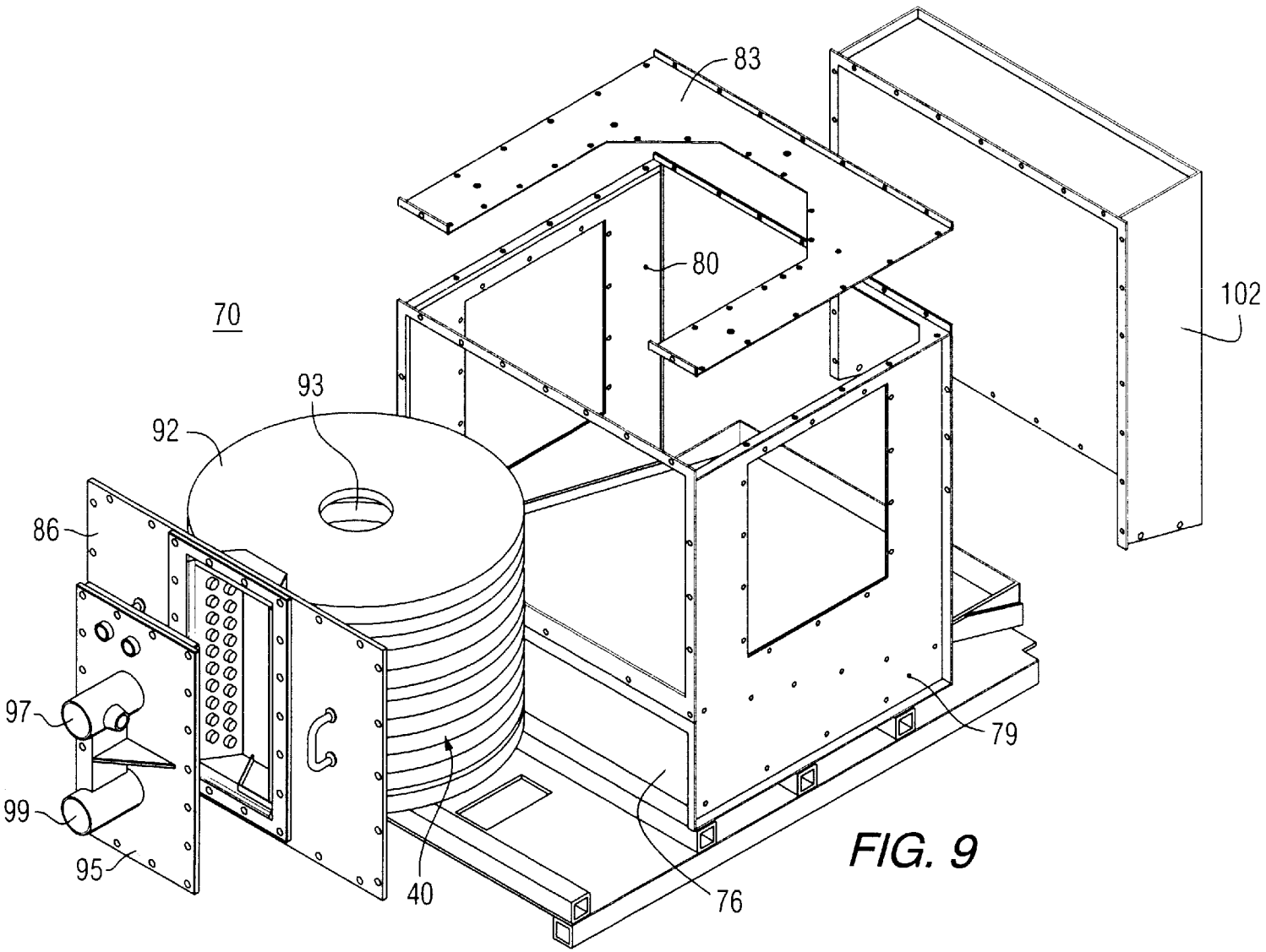
FIG. 9 is an exploded view of the combustion chamber/housing shown in FIG. 8.

Referring now to FIGS. 7 through 9, a presently preferred embodiment of a commercial boiler 70 is illustrated which can utilize the cylindrical heat exchanger member 40. This particular, boiler 70 can be representative of a midsize-conumercial boilef/water heater, which, as shown, utilizes twenty-one dual row stacked annular tubes 43 to form the cylindrical heat exchanger member 40. In a presently preferred embodiment, the tubular rings 43 can be annealed copper tubes. The rated output of such a boiler 70 can be about 2.4 million BTUs per hour ("MBTUhr"). Although the cylindrical heat exchanger member 40 is shown formed from a dual row nested, or staggered, arrangement of twenty-one-stacked tubular rings 43, it is to be understood that it could also be formed from a single row of stacked tubular rings 43. Similarly, the exact number of tubular rings 43, as well as the number of rows, can be increased, or decreased depending on the particular design requirement and/or application. Generally, the rated output of the cylindrical heat exchanger member 40, or rather the boiler 70 utilizing the cylindrical heat exchanger member 40, can be proportional to the number of stacked tubular rings from which the heat exchanger member 40 is formed. For example other factors being the same forming the cylindrical heat exchanger member 40 from twenty tubular rings 43 can result in twice the rated BTU output of a cylindrical heat exchanger member 40 formed from only 10 tubular rings 43.

Additionally, the ability to easily vary the number of tubular rings can provide another important benefit, especially if the size of the boiler changes. A boiler is generally designed for certain water velocities within the tubular members, regardless of boiler BTU/hr size, or output, or whether the tubular members are nng shaped or straight. By reducing the number of tubular members if the boiler size/output is reduced, lower bulk water flows for the boiler can be specified. This is because as the quantity of tubular members drops, the bulk water flow must also drop in order to keep the water velocities constant, at the design, point. If the bulk water flow can be reduced, the result is that smaller, less expensive pumps can be used as the size/output of the boiler is reduced. However, in a conventional boiler, such as using the prior art cylindrical heat exchanger member 20 having straight tubes 23, this cannot happen. This is because the quantity of straight tubular members is not reduced if the boiler size/output is reduced. Instead, the length of the straight tubes 23 is changed, i.e., shortened, if the boiler size/output is changed. Consequently, the bulk water low must be kept the same in order to keep the water velocities at the design point. If the water velocities get too low or too high, the boiler can operate; unsatisfactorily.

The cylindrical heat exchanger member 40 can be enclosed in a housing 73 consisting of a floor 76, side panels 79, 80, a top panel 83 and a front panel 86. The front panel 86 can be connected to the header 46, and can have handles 88, 89 to aid in installing or removing the heat exchanger member 40. A generally circular cover 92, with a hole 93 generally in the center thereof, can be positioned over the heat exchanger member 40 and a cover plate 95 can be provided over the header 46. The cover plate 95 can also cover and help retain the water barrier 60 within the header 46. The cover plate 95 can also include external water inlet 97 and outlet 99 connection members. The inlet 97 can be connected to a source of, typically, water, and the outlet 99 can be connected to plumbing for directing heated water downstream from the boiler 70. Water can flow in through the inlet 97, circulate through the tubular members 43 in the direction dictated by the water barrier 60, during which time the water is heated, and thereafter circulated out of the heat exchanger member 40 through the outlet 99 for delivery downstream from the boiler 70 for use elsewhere in the heating system. As shown in more detail in FIGS. 8 and 9, an opening is provided down through the circular cover 92 into generally the center of the cylindrical heat exchanger member 40. The front side of a flue transition member 102 can form a rear panel of the housing 73 for enclosing the heat exchanger member 40.

Figure 10:
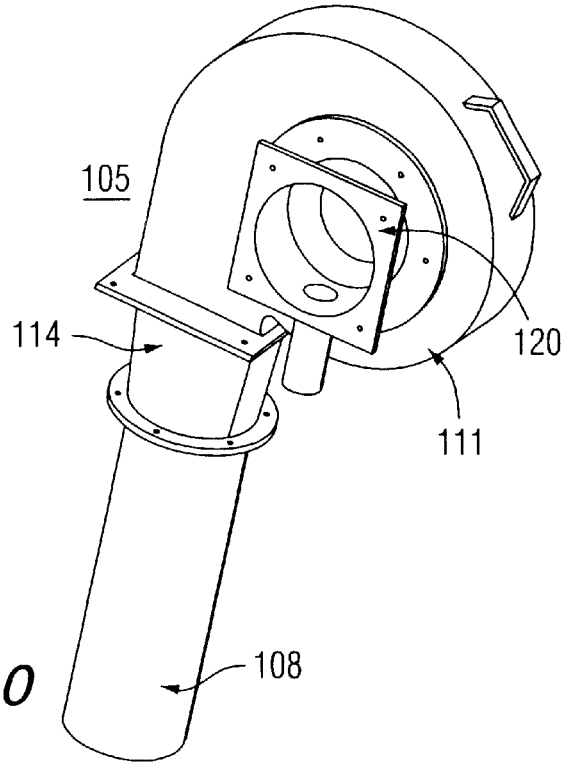
FIG. 10 is a perspective view of an air/gas delivery portion of the boiler shown in FIG. 7.
Figure 11:
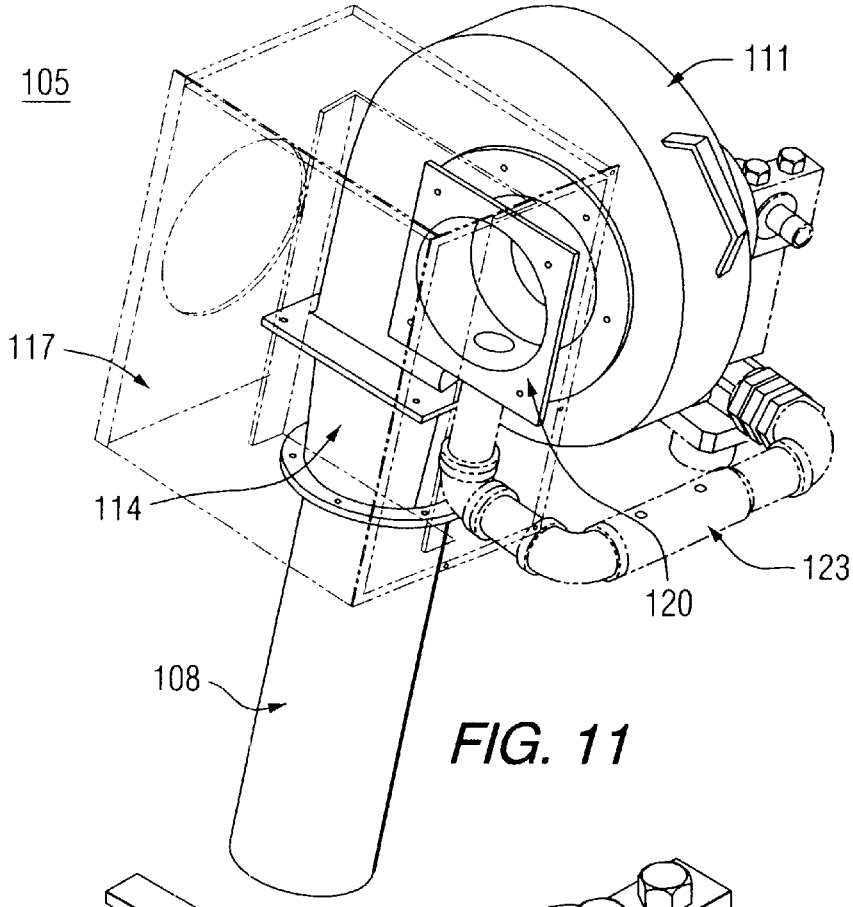
FIG. 11 shows the air/gas delivery portion connected to a gas train and a filter/air inlet box.
Figure 12:
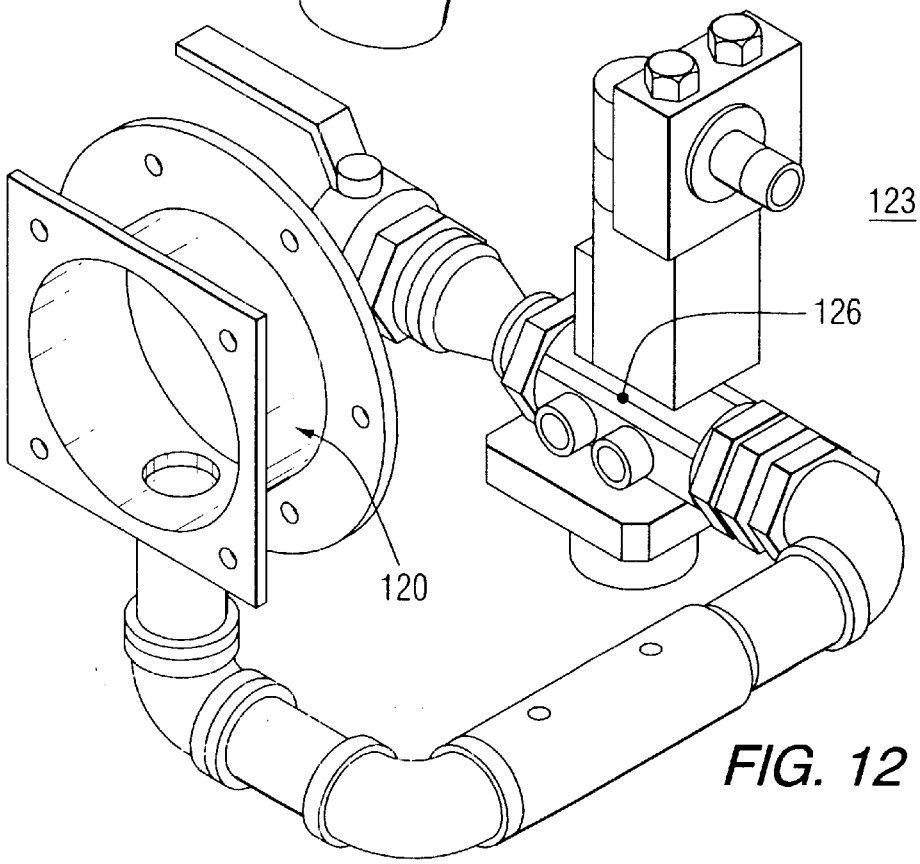
FIG. 12 is an enlarged view of the gas train system shown in FIG. 11.
Figure 13:
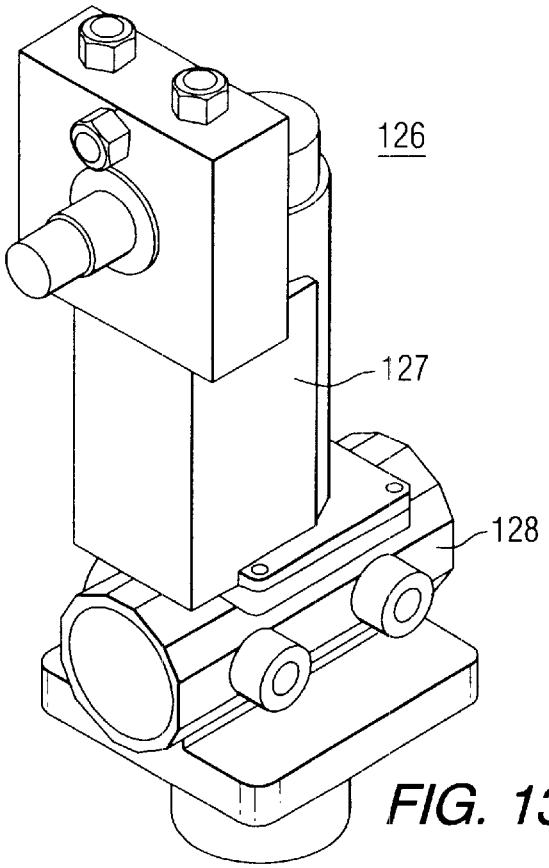
FIG. 13 is a perspective view of Ea valve/actuator assembly for use with the gas train system.

Referring to FIGS. 10 and 11, an air/gas delivery portion 105 is shown including a burner element 108 which can be positioned generally concentrically within the stacked tubular members 43 of the heat exchanger member 40 via the hole 93 in the circular cover 92, as shown in FIG. 7. The air/gas delivery portion 105 can further include a blower member 111, e.g., a motor driven fan enclosed in a housing, which has an outlet side connected to the burner 108 via a blower outlet transition member 114. The inlet side of the blower member 111 is connected to a filter/air inlet boy 17 via an air/gas mixing transition member 120. The air/gas mixing transition member 120, which is thus connected intermediate the blower member 111 and the burner element 108, is also connected to a gas train 123, shown in FIG. 12, which supplies fuel to be consumed by the burner element 108 to heat the water circulated through the cylindrical heat exchanger member 40. In the air/gas mixing transition member 120, fuel from the gas train 123 is mixed with air from the filter/air inlet box 117 to provide the desired fuel/air mixture to the burner element 108. The gas train 123 can include an appropriate valve/actuator assembly126, shown best in FIG. 13, for controlling the delivery and mixture, such as with air, of the fuel delivered to the burner element 108. For example, the valve/actuator assembly 126 can be a VGG™ valve 127 and a SKP50™ actuator 128 manufactured by Landis & Staefa. This particular valve/actuator assembly 126 can modulate the fuel supply to the burner 108 by matching the pressure drop across a gas orifice device 129, shown in FIG. 14, to a pressure drop across an air orifice 163, which can be part of the filter/air inlet box 117, as shown best in FIG. 15. According to methods well known in the art pressure signals, such as indicative of the pressure prevailing on each side of the air orifice 163, can be transmitted via tubing to the valve/actuator assembly 126. The valve/actuator assembly 126 can thus modulate the fuel supply to the burner 108 based upon matching the pressure drop across the gas orifice 163 to the pressure drop across the air orifice 163. The valve/actuator assembly 126 can also include appropriate, conventional safety shut off and pressure regulation features.

Figure 14:
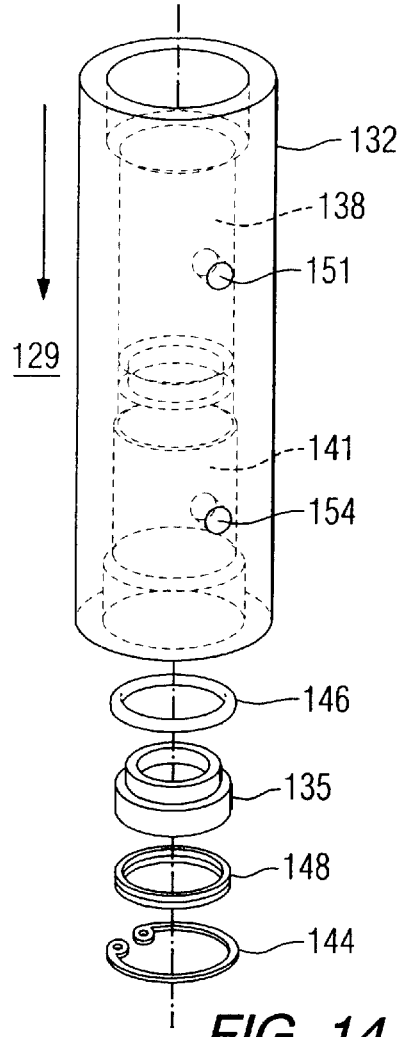
FIG. 14 is an exploded view of a gas orifice member.

Referring to FIG. 14, the gas orifice device 129, which can be a conventional component, available from Comstock Industries Inc., can include an outer, tubular orifice holder portion 132 in which a gas orifice member 135 is retained generally in the middle thereof. The inside of the orifice holder 132 can have two bore portions 138 141 each having a different diameter, between which the gas orifice member 135 is positioned. The gas orifice member 135 can be held inside the orifice holder 132 between the -different diameter bores 138, 141 as shown, for example by a retaining clip 144. An O-ring 146 is positioned on one side of the gas orifice member 135, adjacent the smaller diameter bore 138, and a compression spring 148 is provided on the other side, adjacent the retaining clip 144. An upstream pressure tap 151 is provided communicating with the smaller diameter bore 138 on one side of the gas orifice member 135, and a downstream pressure tap is 154 provided communicating with the larger diameter bore 141 on the opposite side of the gas orifice member 135. The pressure drop across the gas orifice member 135 is utilized by the valve/actuator assembly 126 in determining the proper fuel to air ratio to be supplied to the burner element 108.

Figure 15:
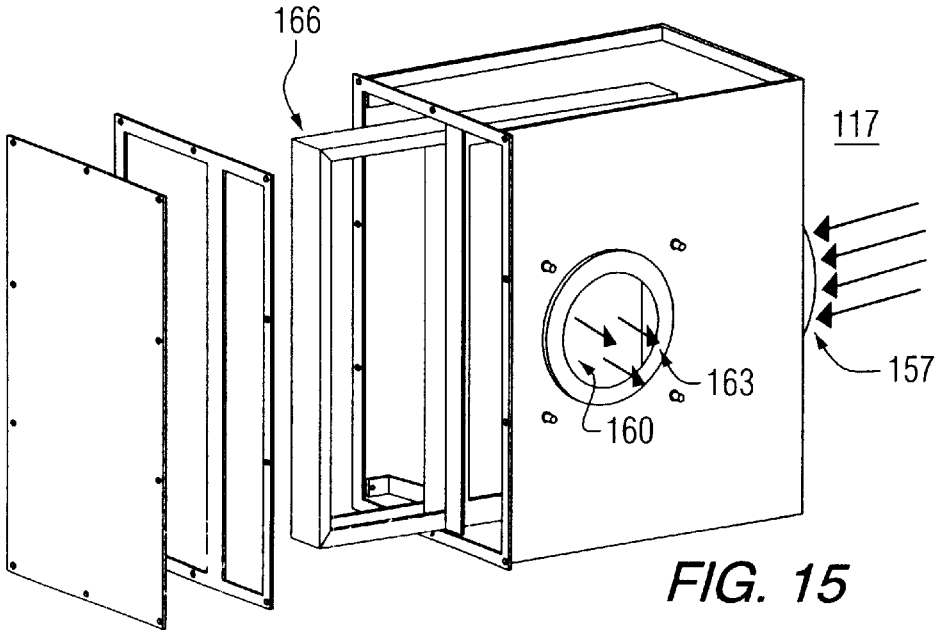
FIG. 15 is a perspective view of the filter/air inlet box (own in FIG. 11.

Referring to FIG. 15, the filter/air inlet box 117 can have an air inlet opening 157 in one side and air outlet opening 160 in another side. The air outlet opening 160 can be defined by an air orifice member 163, which can be the air orifice across which the pressure drop is measured for use in comparison with the pressure drop across the gas orifice device 129, as described above in conjunction with the operation of the valve/actuator assembly 126. The blower member 111 can draw air in through the filter/air inlet box 117 via the air inlet opening 157. The air is mixed with the fuel in the air/gas mixing transition member 120 prior to the burner element 108. A filter 166 is commonly provided, positioned intermediate the air inlet opening 157 and the air outlet opening 160.

Figure 16:
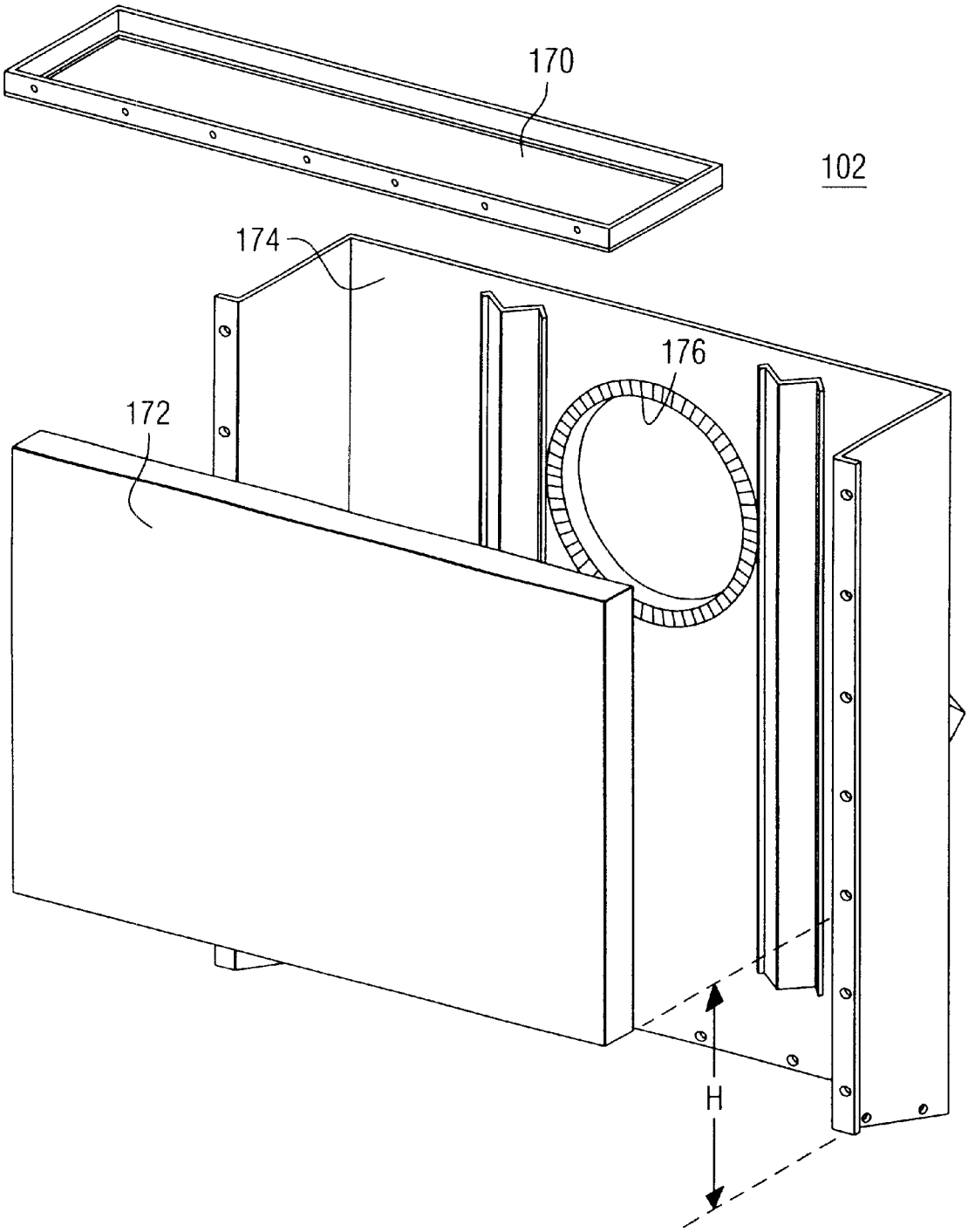
FIG. 16 is a perspective view of the flue transition member shown in FIG. 7.

Referring now to FIG. 16, a more detailed view of the flue transition member 102 shown in FIGS. 7–9. The flue transition member 102 can be a generally rectangular member having top 170, interior 172 and exterior 174 panels defining an enclosure. The exterior panel 174 can have an exhaust opening 176. The interior panel 174, located on the side of the flue transition member 102 adjacent the heat exchanger member 40, can also form the rear panel of the housing 73 which encloses the heat exchanger member 40. The bottom of the flue transition member 102 can be the floor 76 of the, housing 73, which also supports the heat exchanger member 40. The interior panel 174 can terminate at a predetermined distance "H" from the floor 76, such that an opening into the flue transition member 102 enclosure is provided. This opening provides a flow path for combustion products, which are created within the housing by the burner element 108, to be directed into the flue transition member 102 and out therefrom via the exhaust openings 176 in the exterior panel 174. From the exhaust opening 176, the emissions can be disposed of according to environmental regulations.

Generally, in operation of a boiler 70 such as shown in FIG. 7, air is drawn in through the filter/air inlet box 117 by the blower member 111, mixed with fuel in the air/gas mixing transition member 120, and then delivered into the burner element 108 via the blower outlet transition member 114. The fuel/air mixture is combusted by the burner element 108, which is positioned generally concentrically within the cylindrical heat exchanger member 40, thus heating the water which is circulated through the stacked tubular rings 43. The heated water is then circulated from the cylindrical heat exchanger member 40 out of the boiler 70 where it can be used downstream for heating the environment serviced by the boiler 70.

Some advantages of the cylindrical heat exchanger member 40 according to the invention can include a higher firing density while maintaining a proper combustion chamber volume, and a single header 46 with all of the attendant advantages thereof The higher firing density can result from an increased surface area to combustion chamber volume ratio provided by the stacked ring shaped tubular members 43. Other advantages can include simpler and less expensive manufacturing due to the use of a single header 46. The use of a single header 46 also reduces the overall weight of the heat exchanger member. Some other advantages attendant with the single header 46 include the ability to easily configure, and reconfigured, a variety of water passes using the removable/inteiehangeable water barrier 60. Similarly, the header 46 can be easily reconfigured via the water barrier 60 for use with right or left side water connections. Moreover, cleaning of the inside of the individual tubular members 43 can be quickly and easily accomplished because both ends 44, 45 of each of the ring shaped tubular members 43 are accessible at the single header 46 location. Cleaning can be effected, for example, by extending a sufficiently long and flexible cleaning member entirely through each of the tubular members 43 via the each end 44,45 of the tubular members 43 which are easily accessible at the header 46. The cleaning member (not shown) can be similar to a "snake" which is commonly used in the plumbing profession to clear out clogged drain pipes. The cleaning member can have a tip of an appropriate size, shape, and material for effectively cleaning the inside of the tubular members. Cleaning of the outside surface of the tubular members 43 on the inside of the cylinder is also more easily accomplished. This is due to the single header 46 being positioned longitudinally along the side of the cylinder, thus providing better access to the inside of the ring shaped tubular members 43 because both ends of the cylinder are relatively unobstructed. In contrast, the prior art cylindrical heat exchanger member 20, shown in, FIG. 1, has a pair of headers 26,29 which, by necessity, are positioned at each end of the cylinder since that is where each end of the straight tubular members 23 terminate. This positioning of the headers 26, 29 can obstruct the ends of the cylinder, thus hindering access to the inside thereof and making cleaning the outer surfaces of the tubular members 23 difficult.

Although certain embodiments of the invention have been described in detail, it. will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A heat exchanger member comprising:

a. a plurality of ring shaped tubular members arranged to form a generally cylindrical shaped member, each of said plurality of ring shaped tubular members having a first end spaced apart from a second end thereof;

b. a header communicating with each of said first and second ends of each of said plurality of ring shaped tubular members and;

c. a cover plate removably attached to said header, said cover plate defining an enclosed region between said first and second ends when attached to said header, wherein said first and second ends are accessible externally with said cover plate removed; and d. said first and second ends oriented relative to said enclosed region such that direct line-of-sight access to said first and second ends is provided with said cover plate removed.

2. The heat exchanger member of claim 1 further comprising a water barrier interchangeably disposed in said enclosed region and separating said enclosed region into a plurality of sub-regions to define a desired flow path through said plurality of ring shaped tubular members, wherein said water barrier can be interchanged via removing said removable cover plate.

3. The heat exchanger member of claim 1 wherein said header extends longitudinally along said generally cylindrical shaped member.

4. The heat exchanger member of claim 1 further comprising said plurality of ring shaped tubular members arranged in a plurality of rows to form said generally cylindrical shaped member such that respective ring shaped tubular members in respective ones of said plurality of rows have different diameters.

5. The heat exchanger member of claim 4 further comprising said plurality of rows of ring shaped tubular members arranged in a staggered relationship.

6. A method of making a generally cylindrical heat exchanger member comprising:

a. Forming a plurality of tubular members each having first and second ends into a plurality of ring shaped tubular members wherein said first and second ends are spaced apart;

b. arranging said plurality of ring shaped tubular members to form a generally cylindrical shaped member;

c. defining a region of said generally cylindrical shaped member wherein each of said spaced apart first and second ends of each of said plurality of ring shaped tubular members communicates with said region;

d. making said region, and thus each of said spaced apart first and second ends, selectively accessible externally and e. orienting said first and second ends relative to said region such that direct line-of-sight access to said first and second ends is provided when said region is made externally accessible.

7. The method of claim 6 further comprising interchangeably defining a desired flow path through said plurality of ring shaped tubular members by changeably dividing said region into a plurality of sub-regions.

8. The method of claim 6 wherein defining said region further comprises defining said region as a longitudinally extending region along said generally cylindrical shaped member.

9. The method of claim 6 further comprising arranging said plurality of ring shaped tubular members in a plurality of rows to form said generally cylindrical shaped member such that respective ring shaped tubular members in respective ones of said plurality of rows have different diameters.

10. The heat exchanger member of claim 9 further comprising arranging said plurality of rows of ring shaped tubular members in a staggered relationship.

* * * * *